US009760036B2

(12) United States Patent
Shinoya

(10) Patent No.: US 9,760,036 B2
(45) Date of Patent: Sep. 12, 2017

(54) DEVELOPING CARTRIDGE

(71) Applicant: Brother Kogyo Kabushiki Kaisha, Nagoya-shi, Aichi-ken (JP)

(72) Inventor: Shota Shinoya, Nisshin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/277,355

(22) Filed: Sep. 27, 2016

(65) Prior Publication Data

US 2017/0090341 A1 Mar. 30, 2017

(30) Foreign Application Priority Data

Sep. 30, 2015 (JP) ..... 2015-194008

(51) Int. Cl.
*G03G 15/08* (2006.01)
*G03G 21/16* (2006.01)

(52) U.S. Cl.
CPC ..... *G03G 15/0808* (2013.01); *G03G 15/0822* (2013.01); *G03G 15/0865* (2013.01); *G03G 21/1647* (2013.01); *G03G 21/1676* (2013.01)

(58) Field of Classification Search
CPC ..... G03G 15/0808; G03G 15/0818; G03G 15/0822; G03G 15/0865; G03G 21/1647; G03G 21/1676; G03G 2215/0634
USPC ..... 399/279, 286
See application file for complete search history.

(56) References Cited

U.S. PATENT DOCUMENTS 6,275,668 B1 * 8/2001 Batori ..... G03G 15/0935 399/90 X
8,682,216 B2 3/2014 Handa et al.
2001/0021328 A1 * 9/2001 Nishiuwatoko .... G03G 15/0935 399/267
2011/0236063 A1 9/2011 Handa et al.
2013/0051815 A1 * 2/2013 Itabashi ..... G03G 21/1676 399/12
2014/0363189 A1 * 12/2014 Hashimoto ..... G03G 21/1867 399/90
2016/0109849 A1 4/2016 Handa et al.
2016/0238990 A1 8/2016 Handa et al.

FOREIGN PATENT DOCUMENTS

JP 2006-313224 A 11/2006
JP 2011-203367 A 10/2011

* cited by examiner

*Primary Examiner* — Sophia S Chen
(74) *Attorney, Agent, or Firm* — Banner & Witcoff, Ltd.

(57) ABSTRACT

A developing cartridge may include: a developing roller rotatable about a first axis extending in a predetermined direction, the developing roller including a developing roller section; a first shaft; and a second shaft including: a first circumferential surface having a first diameter, a second circumferential surface having a second diameter which is smaller than the first diameter, and a third circumferential surface having a third diameter which is smaller than the second diameter, a bearing having a first hole; a developing roller gear having a second hole, the developing roller gear mounted to the second circumferential surface, and the developing roller gear rotatable with the second shaft, wherein an addendum circle is smaller than a diameter of the developing roller section; and a regulating member, having a third hole located on an opposite side of the bearing, and the regulating member regulates a position of the developing roller gear.

14 Claims, 12 Drawing Sheets

DEVELOPING CARTRIDGE

CROSS-REFERENCE TO RELATED APPLICATION

This application claims priority from Japanese Patent Application No. 2015-194008 filed on Sep. 30, 2015, the entire subject matter of which is incorporated herein by reference.

TECHNICAL FIELD

This disclosure relates to a developing cartridge.

BACKGROUND

A developing cartridge including a developing roller is known. A toner is accommodated in the developing cartridge. The developing cartridge is detachably attached to an image forming apparatus.

The developing cartridge includes a developing roller gear for rotating the developing roller.

The developing roller includes a developing roller shaft, and the developing roller gear is mounted to the developing roller shaft. Further, a bearing is attached to the developing roller shaft.

SUMMARY

There is a need to make the conventional developing roller gear smaller described in a prior art. To satisfy this need, an outer diameter of a new developing roller gear may be smaller than that of the conventional developing roller gear described in the prior art.

In this case, when the new developing roller gear is attached to the conventional developing roller shaft having the same outer diameter as described in the prior art, there is a possibility that a thickness of the developing roller gear is reduced and thus strength of the developing roller gear is reduced based on a difference between the outer diameter of the new developing roller gear and the outer diameter of the conventional developing roller shaft.

Therefore, an object of the present disclosure is to provide a developing cartridge capable of preventing a reduction in strength of a developing roller gear even in a case where an outer diameter of the developing roller gear is reduced.

In consideration of the above, a developing cartridge of this disclosure may include a developing roller, a bearing, a developing roller gear, and a regulating member.

The developing roller may be rotatable about a first axis extending in a predetermined direction, and the developing roller may include: a developing roller section, a first shaft, and a second shaft.

The developing roller section may have a first end in the predetermined direction and a second end separated from the first end in the predetermined direction.

The first shaft may extend from the first end of the developing roller section in the predetermined direction and may be rotatable with the developing roller section.

The second shaft may extend from the second end of the developing roller section in the predetermined direction. The second shaft may be rotatable with the developing roller section. The second shaft may include: a first circumferential surface, a second circumferential surface, and a third circumferential surface. The first circumferential surface may have a first diameter. A second circumferential surface may have a second diameter smaller than the first diameter and may be located at a position farther from the developing roller section than the first circumferential surface in the predetermined direction. The third circumferential surface may have a third diameter smaller than the second diameter and may be located at a position farther from the developing roller section than the second circumferential surface in the predetermined direction.

The bearing may have a first hole into which the first circumferential surface is inserted. The bearing may be attached to the first circumferential surface.

The developing roller gear may have a second hole, into which the second circumferential surface is inserted. The developing roller gear may be mounted to the second circumferential surface. The developing roller gear may be rotatable with the second shaft. The developing roller gear including a plurality of gear teeth provided on a circumferential surface of the developing roller gear and an addendum circle of the plurality of the gear teeth is smaller than a diameter of the developing roller section.

The regulating member may have a third hole into which the third circumferential surface is inserted. The regulating member may be located at an opposite side of the bearing with respect to the developing roller gear in the predetermined direction. The regulating member may be configured to regulate a position of the developing roller gear in the predetermined direction.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

1. Outline of Developing Cartridge 1

Figure 1:
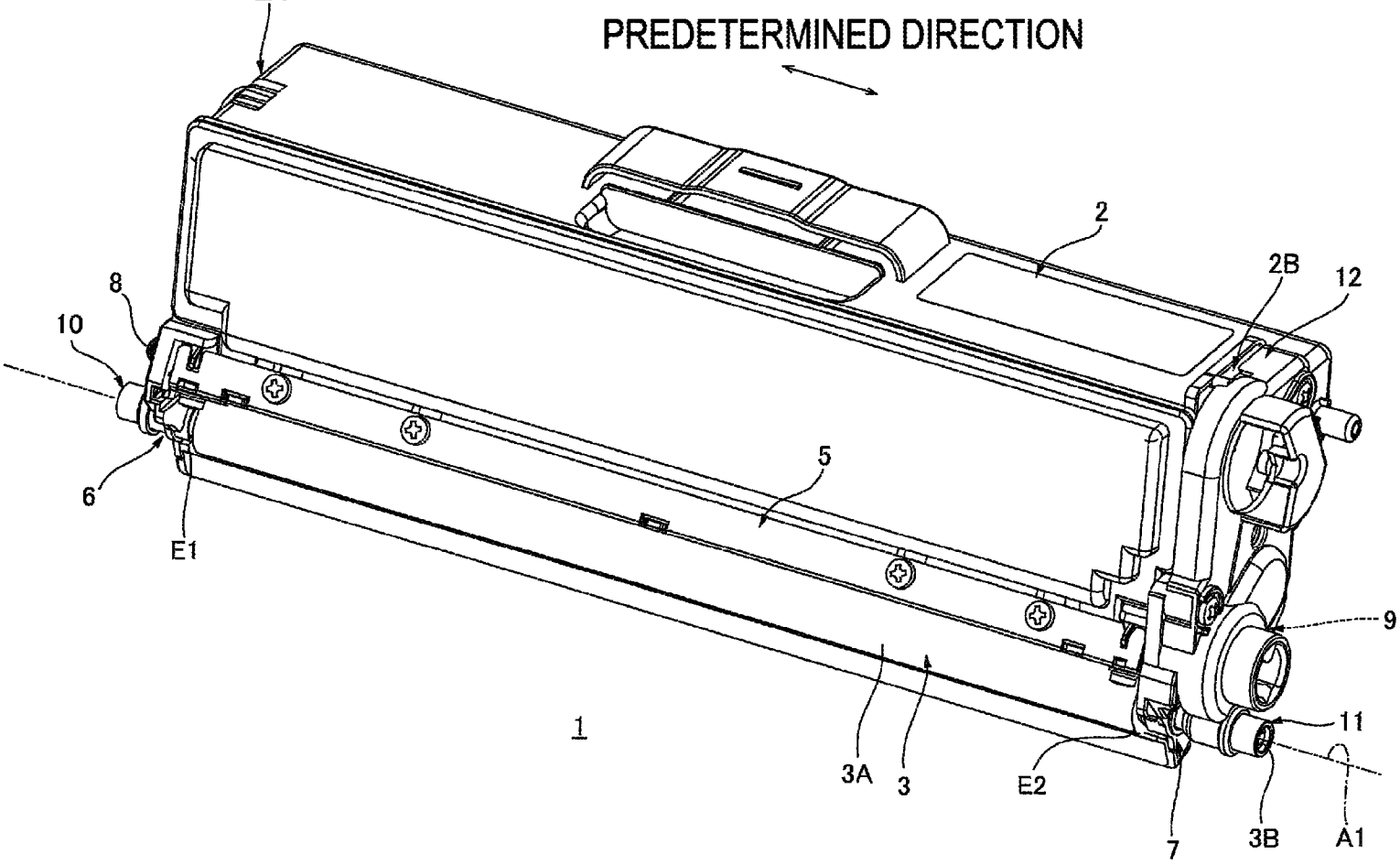
FIG. 1 is a perspective view illustrating a developing cartridge of this disclosure.

As illustrated in FIG. 1, a developing cartridge 1 includes a casing 2, a developing roller 3, a layer thickness regulating plate 5, a first bearing 6, a second bearing 7, an electrode 8, a gear train 9, a first collar 10, a second collar 11, and a gear cover 12. The developing roller 3 is rotatable about a first axis A1.

The casing 2 extends in a predetermined direction. The casing 2 is configured to accommodate a developer in the casing 2. The developer is, for example, toner. The casing 2 has the shape of a hollow square tube.

In the following description, a direction in which the first axis A1 extends is a predetermined direction. In the predetermined direction, a side at which the electrode 8 is provided is one side in the predetermined direction, and a side at which the gear train 9 is provided is the other side in the predetermined direction. The casing 2 has a first surface 2A and a second surface 2B, which is separated from the first surface 2A in the predetermined direction. The first surface 2A is a portion of an outer surface of the casing 2. The second surface 2B is also a portion of the outer surface of the casing 2. In detail, a surface at which the electrode 8 is located is the first surface 2A, and a surface at which the gear cover 12 is located is the second surface 2B.

1.1 Developing Roller 3

As illustrated in FIG. 1, the developing roller 3 includes a developing roller section 3A and a developing roller shaft 3B.

The developing roller section 3A extends in the predetermined direction. The developing roller section 3A has a cylindrical shape. An outer diameter of the developing roller section 3A is, for example, greater than or equal to 13.00 mm and less than or equal to 13.10 mm. The outer diameter of the developing roller section 3A may be greater than or equal to 11.00 mm and less than or equal to 15.10 mm. The developing roller section 3A is made of, for example, a conductive rubber. The developing roller section 3A is positioned between the first surface 2A and second surface 2B of the casing 2 in the predetermined direction. A portion of a circumferential surface of the developing roller section 3A is exposed to the outside of the casing 2. The developing roller section 3A has a first end E1 and a second end E2. The first end E1 is one end of the developing roller section 3A in the predetermined direction. The first end E1 and the second end E2 are positioned between the first surface 2A and the second surface 2B in the predetermined direction, respectively. The first end E1 is located apart from the first surface 2A at an interval in the predetermined direction. The second end E2 is the other end of the developing roller section 3A in the predetermined direction. The second end E2 is separated from the first end E1 in the predetermined direction. The second end E2 is located apart from the second surface 2B at an interval in the predetermined direction.

The developing roller shaft 3B extends in the predetermined direction. The developing roller section 3A is rotatable with the developing roller shaft 3B. That is, the developing roller 3 is rotatable about the developing roller shaft 3B. For this reason, the developing roller 3 is rotatable about the first axis A1 extending in the predetermined direction. The developing roller shaft 3B has a columnar shape. The developing roller shaft 3B is formed of a metal. The developing roller shaft 3B is longer than the developing roller section 3A in the predetermined direction. The developing roller shaft 3B penetrates through the developing roller section 3A in the predetermined direction.

1.2 Layer Thickness Regulating Blade 5

As illustrated in FIG. 1, the layer thickness regulating blade 5 is disposed such that a distal end of the layer thickness regulating blade 5 is in contact with a surface of the developing roller section 3A.

1.3 First Bearing 6

As illustrated in FIG. 1, the first bearing 6 is located at one side of the casing 2 in the predetermined direction. Specifically, the first bearing 6 is attached to the first surface 2A of the casing 2. The first bearing 6 is formed of a conductive resin.

1.4 Gear Train 9

As illustrated in FIG. 1, the gear train 9 is located at the other side of the casing 2 in the predetermined direction. Specifically, the gear train 9 is located at the second surface 2B of the casing 2.

1.5 Second Bearing 7

As illustrated in FIG. 1, the second bearing 7 is located at the other side of the casing 2 in the predetermined direction. Specifically, the second bearing 7 is attached to the second surface 2B of the casing 2.

1.6 Electrode 8

As illustrated in FIG. 1, the electrode 8 is supported by the first bearing 6. Specifically, the electrode 8 is located on the opposite side of the second bearing 7 with respect to the first bearing 6 in the predetermined direction. The electrode 8 is electrically connected to the first bearing 6.

1.7 First Collar 10

As illustrated in FIG. 1, the first collar 10 is located at one side of the casing 2 in the predetermined direction. Specifically, the first collar 10 is located on the opposite side of the second bearing 7 with respect to the first bearing 6 in the predetermined direction. The first collar 10 is located on the opposite side of the developing roller section 3A with respect to the first bearing 6 in the predetermined direction.

1.8 Second Collar 11

As illustrated in FIG. 1, the second collar 11 is located on the opposite side of the casing 2 in the predetermined direction. Specifically, the second collar 11 is located on the opposite side of the first bearing 6 with respect to the second bearing 7 in the predetermined direction. The second collar 11 is located on the opposite side of the developing roller section 3A with respect to the second bearing 7 in the predetermined direction. The second collar 11 is an example of the regulating member.

1.9 Gear Cover 12

The gear cover 12 covers the gear train 9. The gear cover 12 may cover at least a portion of the gear train 9. The gear cover 12 is located on the other side of the casing 2 in the predetermined direction. Specifically, the gear cover 12 is attached to the second surface 2B of the casing 2.

1.10 Supply Roller 4

Figure 2:
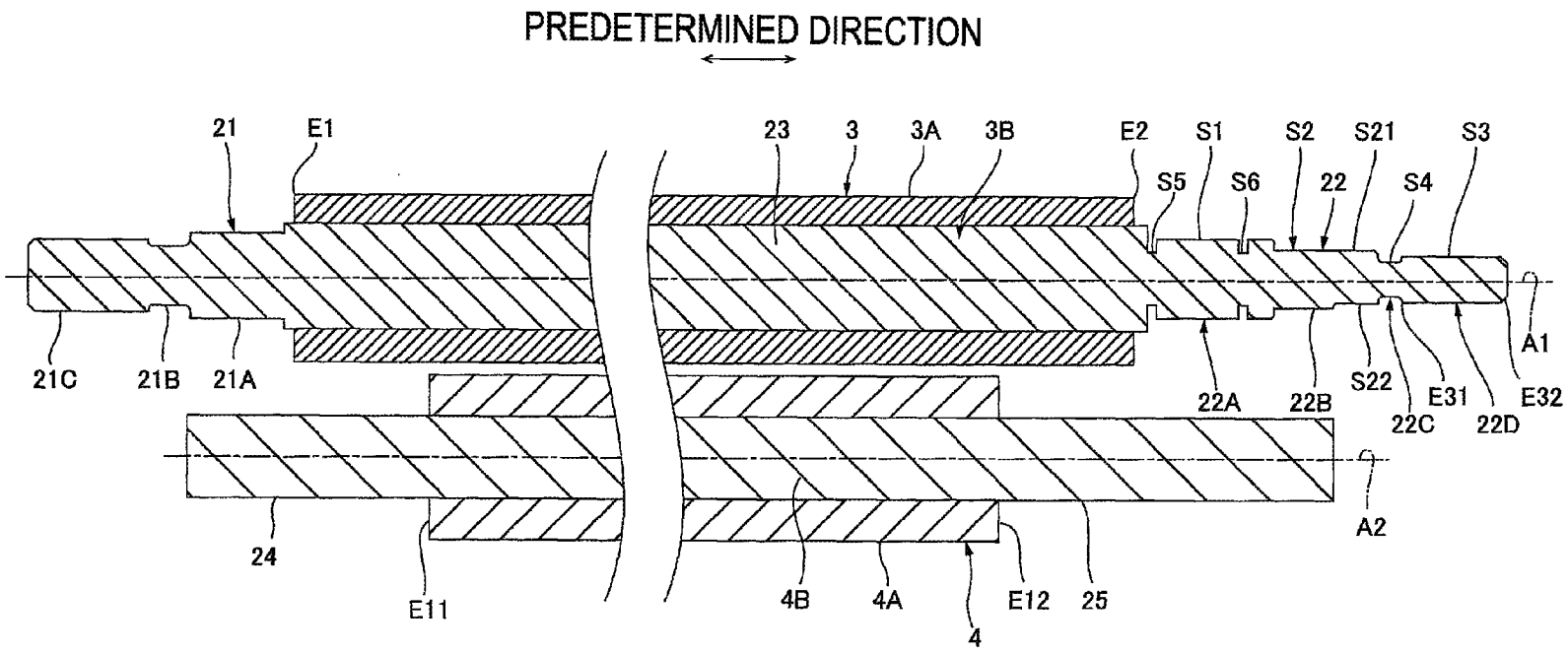
FIG. 2 is a cross-sectional view illustrating a developing roller and a supply roller illustrated in FIG. 1.

As illustrated in FIG. 2, the developing cartridge 1 further includes a supply roller 4. The supply roller 4 is a roller for supplying the toner in the casing 2 to the developing roller 3. The supply roller 4 includes a supply roller section 4A and a supply roller shaft 4B.

The supply roller section 4A extends in the predetermined direction. The supply roller section 4A has a cylindrical shape. The supply roller section 4A is formed of, for example, a conductive sponge. The supply roller section 4A is located in the casing 2. A circumferential surface of the supply roller section 4A comes into contact with the developing roller section 3A in the casing 2. A length of the supply roller section 4A in the predetermined direction is shorter than that of the developing roller section 3A in the predetermined direction. The supply roller section 4A has a first end E11 that is one end of the supply roller section 4A and a second end E12 that is the other end of the supply roller section 4A in the predetermined direction. The second end E12 is separated from the first end E11 in the predetermined direction. The first end E11 and the second end E12 are positioned between the first end E1 and the second end E2 of the developing roller section 3A in the predetermined direction.

The supply roller shaft 4B extends in the predetermined direction. The supply roller shaft 4B has a columnar shape. The supply roller shaft 4B is rotatable with the supply roller section 4A. That is, the supply roller 4 is rotatable about the supply roller shaft 4B. For this reason, the supply roller 4 is rotatable about a second axis A2 extending in the predetermined direction. The supply roller shaft 4B is formed of a metal. The supply roller shaft 4B penetrates through the supply roller section 4A in the predetermined direction. The supply roller shaft 4B includes a first protrusion 24 as an example of a fourth shaft and a second protrusion 25 as an example of a third shaft.

The first protrusion 24 protrudes from the first end E11 in the predetermined direction. That is, the first protrusion 24 extends from the first end E11 in the predetermined direction.

The second protrusion 25 protrudes from the second end E12 in the predetermined direction. The second protrusion 25 extends from the second end E12 in the predetermined direction.

2. Details of Developing Roller Shaft 3B

Hereinafter, details of the developing roller shaft 3B will be described using FIG. 2. The developing roller shaft 3B includes a first protrusion 21 as an example of a first shaft, a second protrusion 22 as an example of a second shaft, and a main body 23. The first protrusion 21 extends from the main body 23. The second protrusion 22 extends from the main body 23. The first protrusion 21, the second protrusion 22, and the main body 23 may be formed integrally. Instead of the developing roller shaft 3B, the first protrusion 21 may protrude from the first end E1 in the predetermined direction, and the second protrusion 22 may protrude from the second end E2 in the predetermined direction. That is, the main body 23 may not be present. In this case, the first protrusion 21 extends from the first end E1 in the predetermined direction, and the second protrusion 22 protrudes from the second end E2 in the predetermined direction.

2.1 First Protrusion 21

The first protrusion 21 protrudes from the first end E1 in the predetermined direction. That is, the first protrusion 21 extends from the first end E1 in the predetermined direction. The first protrusion 21 is located on the opposite side of the second protrusion 22 with respect to the developing roller section 3A. The first protrusion 21 includes a first portion 21A, a second portion 21B, and a third portion 21C. The second portion 21B is located at a position farther from the first end E1 than the first portion 21A in the predetermined direction. The third portion 21C is located at a position farther from the first end E1 than the second portion 21B in the predetermined direction.

The first portion 21A extends from one end of the main body 23 in the predetermined direction. The first portion 21A is positioned between the first end E1 and the second portion 21B in the predetermined direction. The first portion 21A has a columnar shape. That is, a circumferential surface of the first portion 21A has a circular shape as viewed in the predetermined direction. The circumferential surface of the first portion 21A has a smaller outer diameter than an outer diameter of the main body 23 as viewed in the predetermined direction. The outer diameter of the circumferential surface of the first portion 21A is, for example, greater than or equal to 6.47 mm and less than or equal to 6.50 mm. The outer diameter of the circumferential surface of the first portion 21A may be greater than or equal to 6.00 mm and less than or equal to 7.00 mm.

The second portion 21B extends from an end of the first portion 21A in the predetermined direction. The second portion 21B is located on the opposite side of the first end E1 with respect to the first portion 21A in the predetermined direction. The second portion 21B is positioned between the first portion 21A and the third portion 21C in the predetermined direction. The second portion 21B has a columnar shape. That is, a circumferential surface of the second portion 21B has a circular shape as viewed in the predetermined direction. The circumferential surface of the second portion 21B has a smaller outer diameter than the outer diameter of the first portion 21A and the outer diameter of the third portion 21C as viewed in the predetermined direction. The outer diameter of the circumferential surface of the second portion 21B is, for example, greater than or equal to 4.45 mm and less than or equal to 4.50 mm. The outer diameter of the circumferential surface of the second portion 21B may be greater than or equal to 4.00 mm and less than or equal to 5.00 mm.

The third portion 21C extends from an end of the second portion 21B in the predetermined direction. The third portion 21C is located on the opposite side of the first portion 21A with respect to the second portion 21B in the predetermined direction. The third portion 21C is located at a position farther from the first end E11 than the first protrusion 24 in the predetermined direction. The third portion 21C has a columnar shape. That is, a circumferential surface of the third portion 21C has a circular shape as viewed in the predetermined direction. The circumferential surface of the third portion 21C has an outer diameter that is smaller than the outer diameter of the first portion 21A and is greater than the outer diameter of the second portion 21B as viewed in the predetermined direction. The outer diameter of the circumferential surface of the third portion 21C is, for example, greater than or equal to 5.47 mm and less than or equal to 5.50 mm. The outer diameter of the circumferential surface of the third portion 21C may be greater than or equal to 5.00 mm and less than or equal to 6.00 mm.

2.2 Second Protrusion 22

As illustrated in FIG. 2, the second protrusion 22 protrudes from the second end E2 in the predetermined direction. That is, the second protrusion 22 extends from the second end E2 in the predetermined direction. The second protrusion 22 is located on the opposite side of the first protrusion 21 with respect to the developing roller section 3A. The second protrusion 22 includes a first portion 22A, a second portion 22B, and a third portion 22C, and a fourth portion 22D.

The second portion 22B is located at a position farther from the second end E2 than the first portion 22A in the predetermined direction. The third portion 22C is located at a position farther from the second end E2 than the second portion 22B in the predetermined direction. The fourth portion 22D is located at a position farther from the second end E2 than the third portion 22C in the predetermined direction.

The first portion 22A extends from an end of the main body 23 in the predetermined direction. The first portion 22A is positioned between the second end E2 and the second portion 22B in the predetermined direction. The first portion 22A has a columnar shape. Hereinafter, a circumferential surface of the first portion 22A is referred to as a first circumferential surface S1. The first circumferential surface S1 has a circular shape as viewed in the predetermined direction. The first circumferential surface S1 has a smaller outer diameter than the outer diameter of the main body 23 as viewed in the predetermined direction. The outer diameter of the first circumferential surface S1 is, for example, greater than or equal to 5.97 mm and less than or equal to 6.00 mm. The outer diameter of the first circumferential surface S1 may be greater than or equal to 5.00 mm less than or equal to 7.00 mm. The outer diameter of the first circumferential surface S1 is an example of a first diameter. The first portion 22A has one end and the other end in the predetermined direction. The one end of the first portion 22A is located at a position closer to the developing roller section 3A than the other end of the first portion 22A.

The first portion 22A has a fifth circumferential surface S5. The fifth circumferential surface S5 is positioned between the one end of the first portion 22A and the main body 23 in the predetermined direction. The fifth circumferential surface S5 has a circular shape as viewed in the predetermined direction. As viewed in the predetermined direction, an outer diameter of the fifth circumferential surface S5 is smaller than the outer diameter of the first circumferential surface S1. The outer diameter of the fifth circumferential surface S5 is, for example, greater than equal to 4.000 mm and less than or equal to 4.075 mm. The outer diameter of the fifth circumferential surface S5 may be greater than or equal to 3.000 mm and less than or equal to 5.000 mm. The outer diameter of the fifth circumferential surface S5 is an example of a fifth diameter. A first stopper 18 (to be described below) is attached to the fifth circumferential surface S5.

The first portion 22A has a sixth circumferential surface S6. The sixth circumferential surface S6 is located apart from the fifth circumferential surface S5 in the predetermined direction. The sixth circumferential surface S6 is positioned between the other end of the first portion 22A and the main body 23 in the predetermined direction. The sixth circumferential surface S6 is positioned between the one end of the first portion 22A and the other end of the first portion 22A in the predetermined direction. The sixth circumferential surface S6 is located at a position closer to the other end of the first portion 22A than the one end of the first portion 22A in the predetermined direction. The sixth circumferential surface S6 has a circular shape as viewed in the predetermined direction. As viewed in the predetermined direction, an outer diameter of the sixth circumferential surface S6 is smaller than the outer diameter of the first circumferential surface S1. As viewed in the predetermined direction, the outer diameter of the sixth circumferential surface S6 is the same as the outer diameter of the fifth circumferential surface S5. The outer diameter of the sixth circumferential surface S6 is, for example, greater than or equal to 4.000 mm and less than or equal to 4.075 mm. The outer diameter of the sixth circumferential surface S6 may be greater than or equal to 3.000 mm and less than or equal to 5.000 mm. The outer diameter of the sixth circumferential surface S6 is an example of a sixth diameter. A second stopper 19 (to be described below) is attached to the sixth circumferential surface S6.

The second portion 22B extends from the end of the first portion 22A in the predetermined direction. The second portion 22B is located on the opposite side of the second end E2 of the developing roller section 3A with respect to the first portion 22A in the predetermined direction. The second portion 22B is positioned between the first portion 22A and the third portion 22C in the predetermined direction. The second portion 22B has a columnar shape. Hereinafter, a circumferential surface of the second portion 22B is referred to as a second circumferential surface S2. The second circumferential surface S2 is located at a position farther from the developing roller section 3A than the first circumferential surface S1 in the predetermined direction. The second circumferential surface S2 has at least a D shape as viewed in the predetermined direction. In other words, the second circumferential surface S2 has an arc surface S21 and a flat surface S22 in the predetermined direction. The arc surface S21 and the flat surface S22 extend in the predetermined direction, respectively. An outer diameter of the arc surface S21 is smaller than the outer diameter of the first circumferential surface S1. The outer diameter of the arc surface S21 is, for example, greater than or equal to 4.35 mm and less than or equal to 4.40 mm, and may be particularly 4.375 mm. The outer diameter of the arc surface S21 is an example of a second diameter.

The third portion 22C extends from the end of the second portion 22B in the predetermined direction. The third portion 22C is located on the opposite side of the first portion 22A with respect to the second portion 22B in the predetermined direction. The third portion 22C is positioned between the second portion 22B and the fourth portion 22D in the predetermined direction. The third portion 22C has a columnar shape. Hereinafter, a circumferential surface of the third portion 22C is referred to as a fourth circumferential surface S4. The fourth circumferential surface S4 is positioned between the second circumferential surface S2 and a third circumferential surface S3 (to be described below) in the predetermined direction. The fourth circumferential surface S4 has a circular shape as viewed in the predetermined direction. An outer diameter of the fourth circumferential surface S4 is smaller than the outer diameter of the second circumferential surface S2 as viewed in the predetermined direction. The outer diameter of the fourth circumferential surface S4 is smaller than the outer diameter of the third circumferential surface S3 (to be described below). The outer diameter of the fourth circumferential surface S4 is, for example, greater than or equal to 2.60 mm and less than or equal to 2.65 mm. The outer diameter of the fourth circumferential surface S4 may be greater than or equal to 2.00 mm and less than or equal to 3.00 mm. The outer diameter of the fourth circumferential surface S4 is an example of a fourth diameter.

The fourth portion 22D extends from the end of the third portion 22C in the predetermined direction. The fourth portion 22D is located on the opposite side of the second portion 22B with respect to the third portion 22C in the predetermined direction. The fourth portion 22D is located at a position farther from the second end E2 than the second protrusion 25 in the predetermined direction. The fourth portion 22D has a columnar shape. Hereinafter, a circumferential surface of the fourth portion 22D is referred to as a third circumferential surface S3. The third circumferential surface S3 is located at a position farther from the developing roller section 3A than the second circumferential surface S2 in the predetermined direction. The third circumferential surface S3 has a circular shape as viewed in the predetermined direction. As viewed in the predetermined direction, an outer diameter of the third circumferential surface S3 is smaller than the outer diameter of the second circumferential surface S2, and is greater than the outer diameter of the fourth circumferential surface S4. The outer diameter of the third circumferential surface S3 is, for example, greater than or equal to 3.47 mm and less than or equal to 3.50 mm. The outer diameter of the third circumferential surface S3 may be greater than or equal to 3.00 mm and less than or equal to 4.00 mm. The outer diameter of the third circumferential surface S3 is an example of a third diameter. The third circumferential surface S3 is located at a position closer to a center of the developing roller shaft 3B than the flat surface S22 of the second circumferential surface S2 in a radial direction of the developing roller shaft 3B. The third circumferential surface S3 has with a first end E31 and a second end E32. The first end E31 is one end of the third circumferential surface S3 in the predetermined direction. The first end E31 is located at a position closer to the fourth circumferential surface S4 than the second end E32 in the predetermined direction. The second end E32 is the other end of the third circumferential surface S3 in the predetermined direction. That is, the second end E32 is separated from the first end E31 in the predetermined direction.

2.3 Main Body 23

As illustrated in FIG. 2, the main body 23 is positioned between the first protrusion 21 and the second protrusion 22. The main body 23 has a columnar shape. The main body 23 extends in the predetermined direction. An outer diameter of the main body 23 is greater than or equal to 7.85 mm and less than or equal to 8.00 mm. The outer diameter of the main body 23 may be greater than or equal to 7.00 mm and less than or equal to 9.00 mm. The main body 23 is covered by the developing roller section 3A.

3. Details of First Bearing 6, Electrode 8, and First Collar 10

Hereinafter, details of the first bearing 6, the electrode 8, and the first collar 10 will be described with reference to FIGS. 3 to 5.

Figure 4:
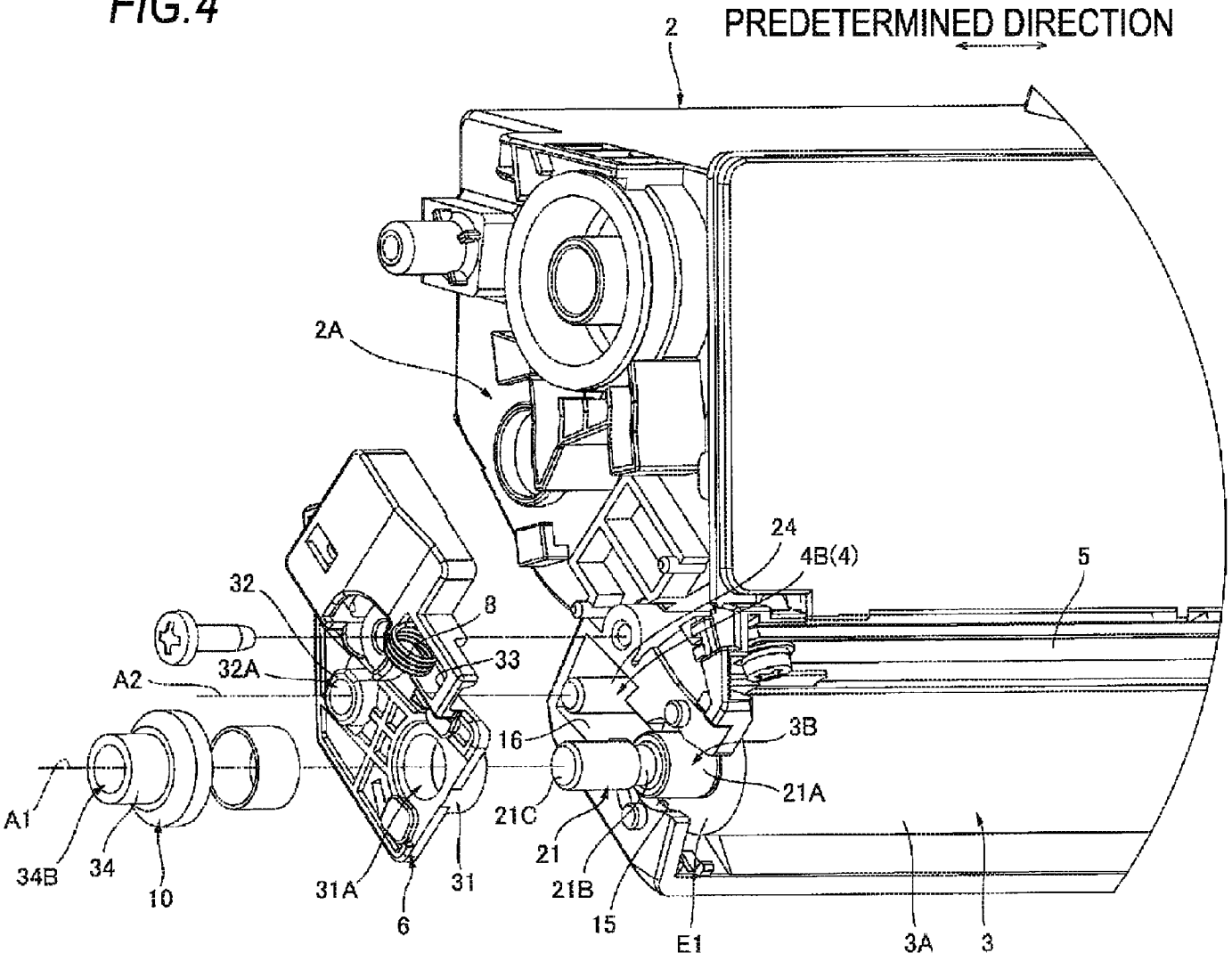
FIG. 4 is an exploded perspective view of one end of the developing cartridge illustrated in FIG. 1 in the predetermined direction.

As illustrated in FIG. 4, the first protrusion 21, which penetrates through a through-hole 15 of the casing 2 in the predetermined direction, extends outward and extends farther from the first surface 2A in the predetermined direction, in a state where the developing roller 3 is attached to the casing 2. The through-hole 15 penetrates through the first surface 2A in the predetermined direction.

The first portion 21A is located within the through-hole 15. As viewed in the predetermined direction, the circumferential surface of the first portion 21A has a smaller outer diameter than an inner diameter of the through-hole 15. The circumferential surface of the first portion 21A is spaced apart from an inner surface of the through-hole 15 in a radial direction of the first portion 21A. The second portion 21B and the third portion 21C are located at a position farther from the developing roller section 3A than the first face 2A in the predetermined direction.

As illustrated in FIG. 4, the first protrusion 24, which penetrates through a through-hole 16 of the casing 2 in the predetermined direction, extends outward and extends farther from the first surface 2A in the predetermined direction, in a state where the supply roller 4 is attached to the casing 2. The through-hole 16 is located next to the through-hole 15, and penetrates through the first surface 2A of the casing 2 in the predetermined direction.

3.1 Details of First Bearing 6

Figure 3:
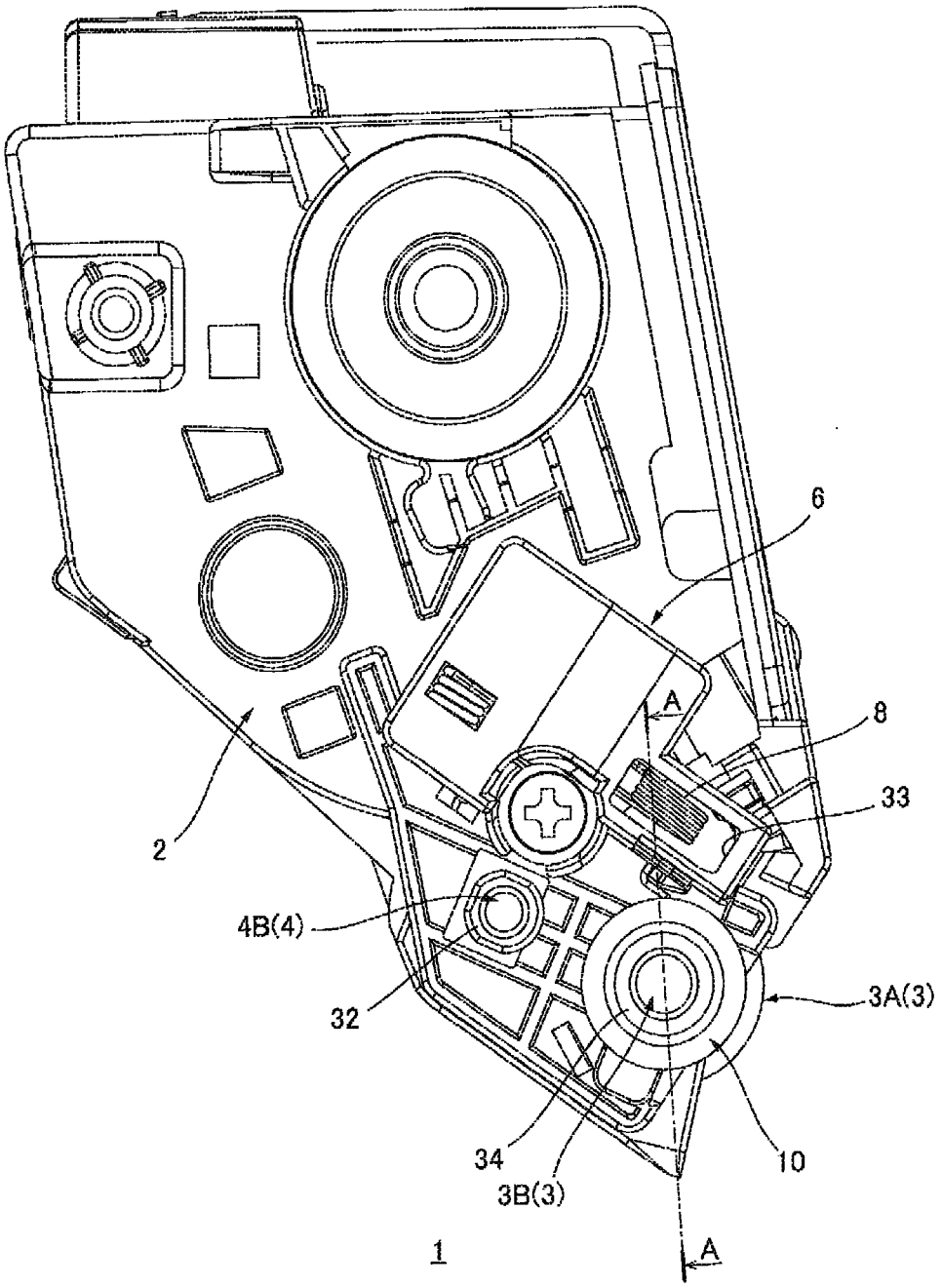
FIG. 3 is a side view of the developing cartridge illustrated in FIG. 1 as viewed from one side in a predetermined direction.
Figure 5:
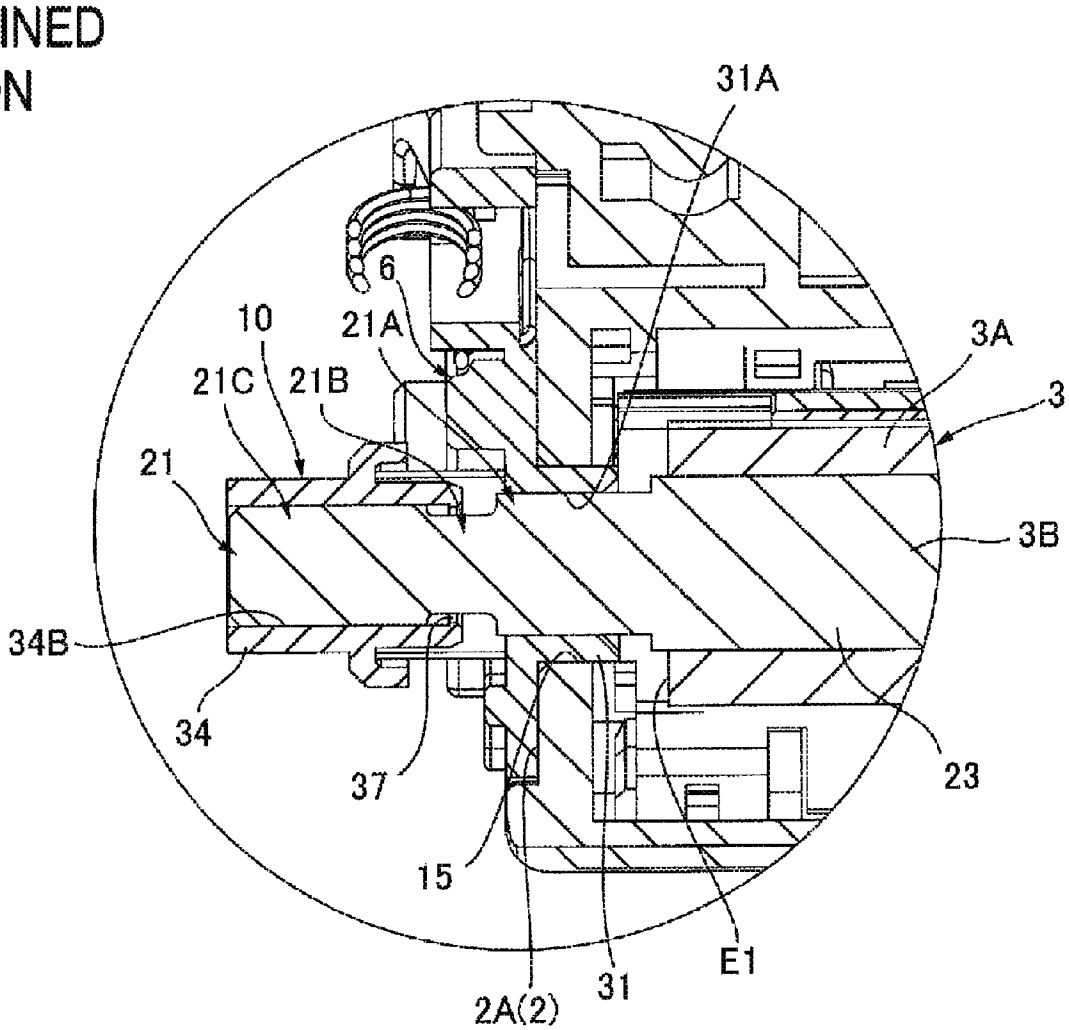
FIG. 5 is a cross-sectional view taken along line A-A of the developing cartridge illustrated in FIG. 3.
Figure 6:
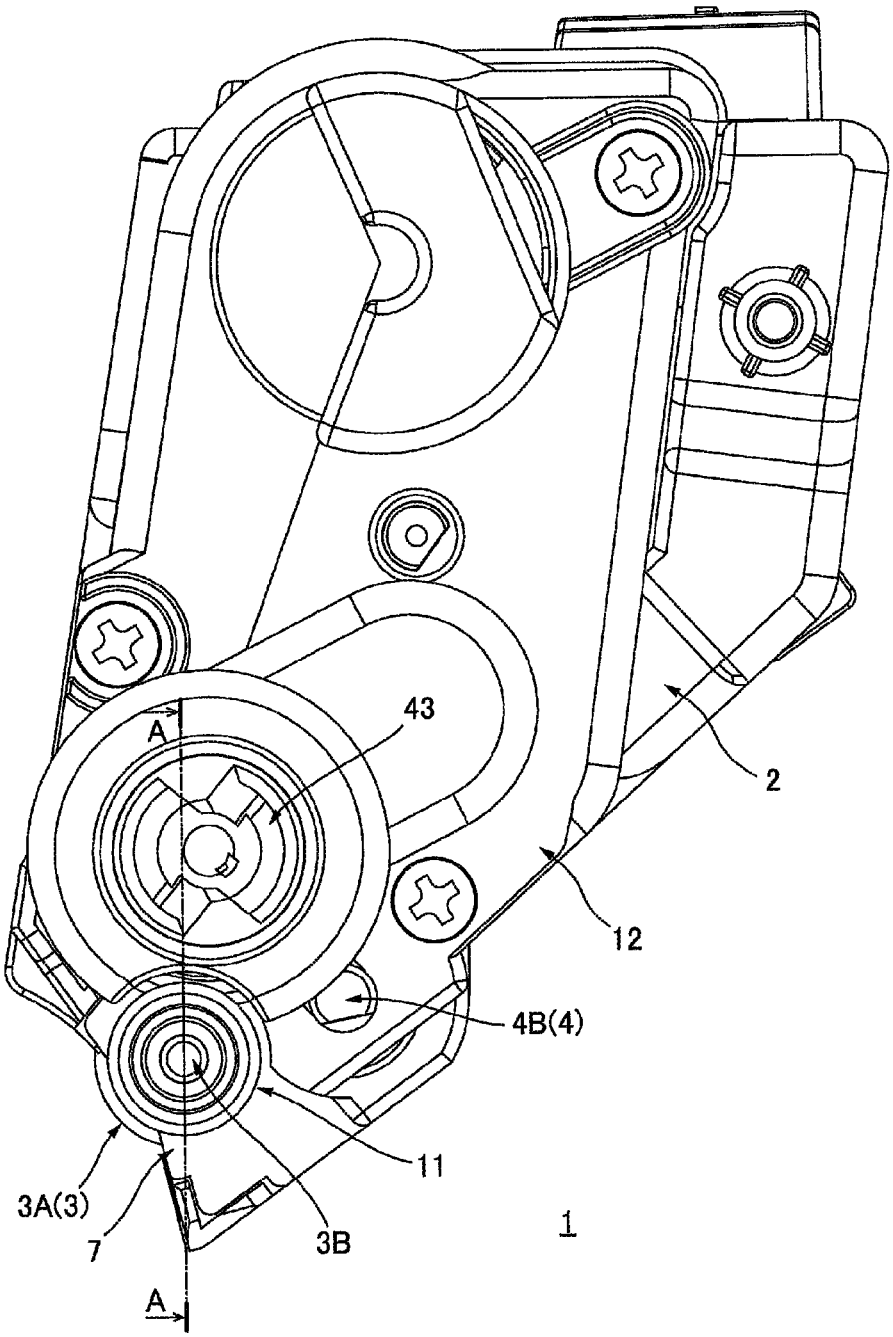
FIG. 6 is a side view of the developing cartridge illustrated in FIG. 1 as viewed from the other side in the predetermined direction.

As illustrated in FIGS. 3 to 5, the first bearing 6 is located at the first surface 2A of the casing 2. The first bearing 6 is attached to the first surface 2A of the casing 2. The first bearing 6 is formed of a conductive resin. The first bearing 6 has an opening 33. The first bearing 6 includes a developing bearing section 31 having a through-hole 31A and a supply bearing section 32 having a through-hole 32A.

The opening 33 penetrates through the first bearing 6 in the predetermined direction.

The developing bearing section 31 has a cylindrical shape. The developing bearing section 31 extends in the predetermined direction. The developing bearing section 31 has an outer diameter, and the size of the outer diameter of the developing bearing section 31 is nearly same size of the inner diameter of the through-hole 15. The developing bearing section 31 is fitted into the through-hole 15 of the first surface 2A.

The through-hole 31A penetrates through the developing bearing section 31 in the predetermined direction. The through-hole 31A has the inner diameter and the size of the inner diameter of the through-hole 31A is the substantially same size of the outer diameter of the first portion 21A. The first portion 21A is rotatably inserted into the through-hole 31A. Thereby, the developing bearing section 31 is electrically connected to the developing roller shaft 3B, because a portion of the developing roller shaft 3B is in contact with the developing bearing section 31.

The supply bearing section 32 has a cylindrical shape. The supply bearing section 32 extends in the predetermined direction.

The through-hole 32A penetrates through the supply bearing section 32 in the predetermined direction. The through-hole 32A has the inner diameter, and the size of the inner diameter of the through-hole 32A is the substantially same size of the outer diameter of the first protrusion 24. The first protrusion 24 is rotatably inserted into the through-hole 32A. Thereby, the supply bearing section 32 is electrically connected to the supply roller shaft 4B, because a portion of the supply roller shaft 4B is in contact with the supply bearing section 32.

3.2 Details of Electrode 8

As illustrated in FIG. 4, the electrode 8 is supported between the first bearing 6 and the first surface 2A in the predetermined direction, and at least a portion of the electrode 8 is exposed from the opening 33. The electrode 8 is electrically connected to the first bearing 6. When the developing cartridge 1 is mounted to an image forming apparatus, the electrode 8 receives electric power from the image forming apparatus. The electric power which inputs to the electrode 8 is supplied to the developing roller shaft 3B via the developing bearing section 31 of the first bearing 6. The electric power which inputs to the electrode 8 is also supplied to the supply roller shaft 4B via the supply bearing section 32 of the first bearing 6.

3.3 Details of First Collar 10

As illustrated in FIGS. 4 and 5, the first collar 10 is located on the opposite side of the developing roller section 3A with respect to the developing bearing section 31 of the first bearing 6 in the predetermined direction. The first collar 10 includes a tube section 34 having a through-hole 34B.

The tube section 34 has a cylindrical shape. The tube section 34 extends in the predetermined direction. The tube section 34 includes a claw 37. The tube section 34 has one end and the other end in the predetermined direction. The one end of the tube section 34 is located at a position farther from the developing roller section 3A than the other end of the tube section 34.

The through-hole 34B penetrates through the tube section 34 in the predetermined direction. The through-hole 34B has the inner diameter, and the size of the inner diameter of the through-hole 34B is the substantially same size of the outer diameter of the third portion 21C. The third portion 21C is inserted into the through-hole 34B. Thereby, the first collar 10 is attached on the third portion 21C. The tube section 34 is slidable relative to the third portion 21C. Thereby, the first collar 10 is rotatable relative to the developing roller shaft 3B.

The claw 37 is located at the other end of the tube section 34 in the predetermined direction. The claw 37 protrudes inward in a radial direction of the tube section 34. The claw 37 is attached to the second portion 21B. The claw 37 can come into contact with the third portion 21C.

4. Configuration of Second Bearing 7 and Gear Train 9.

Hereinafter, details of the second bearing 7 and the gear train 9 will be described with reference to FIGS. 6 to 10.

Figure 8:
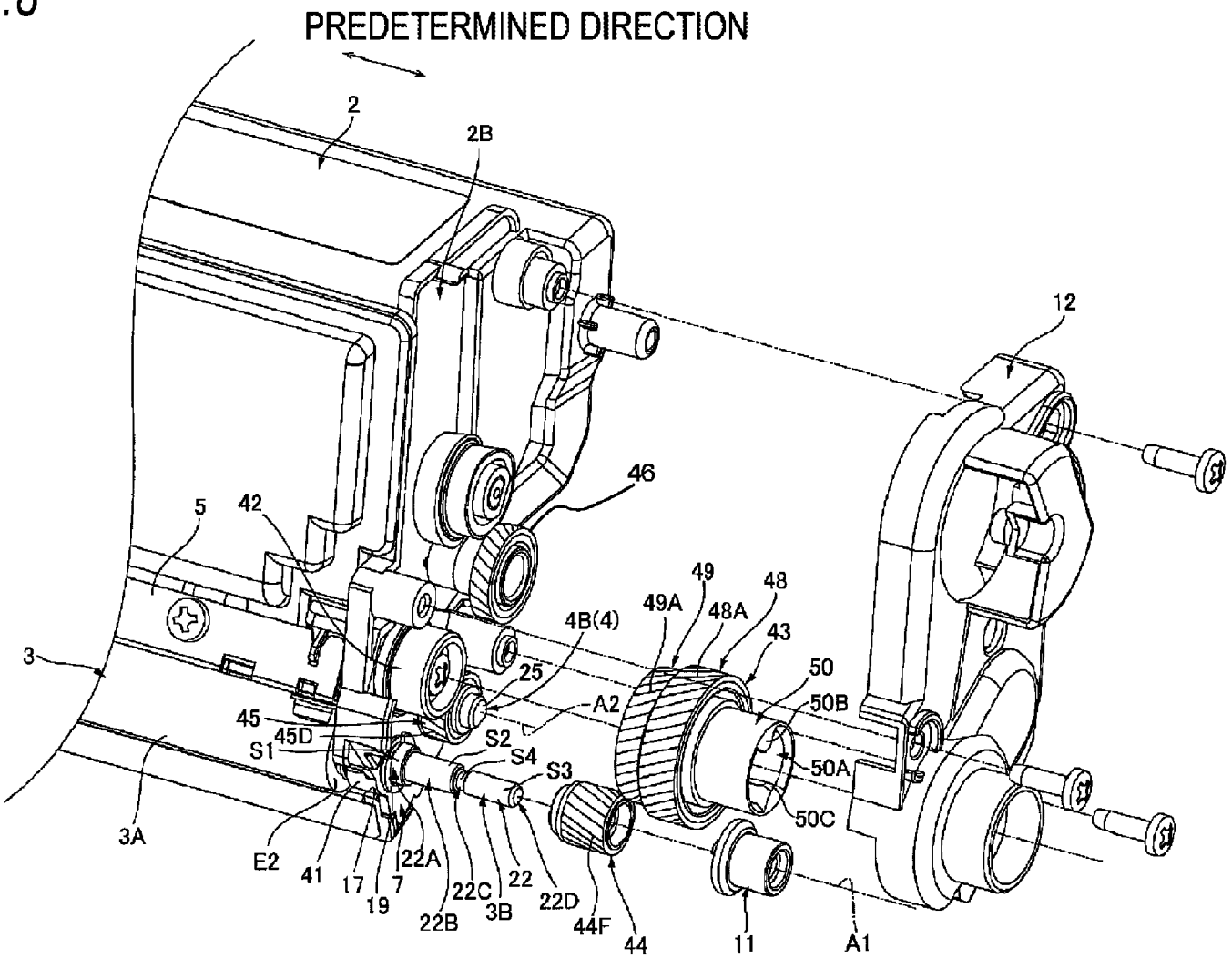
FIG. 8 is an exploded perspective view of the other end of the developing cartridge illustrated in FIG. 1 in the predetermined direction.

As illustrated in FIG. 8, the second protrusion 22, which penetrates through the through-hole 17 of the casing 2 in the predetermined direction, extends outward and extends farther from the second surface 2B in the state where the developing roller 3 is attached to the casing 2. The through-hole 17 penetrates through the second surface 2B in the predetermined direction. At least a portion of the through-hole 17 and at least a portion of the through-hole 15 are aligned in the predetermined direction. The first portion 22A is located within the through-hole 17. As viewed in the predetermined direction, the outer diameter of the first circumferential surface S1 is smaller than an inner diameter of the through-hole 17. The first circumferential surface S1 is spaced apart from an inner surface of the through-hole 17 in a radial direction of the first portion 22A. The second portion 22B, the third portion 22C, and the fourth portion 22D are located at a position farther from the developing roller section 3A than the second surface 2B in the predetermined direction.

The second protrusion 25, which penetrates through a through-hole (not illustrated) of the casing 2 in the predetermined direction in the state where the supply roller 4 is attached to the casing 2. The through-hole (not illustrated) penetrates through the second surface 2B in the predetermined direction. As viewed in the predetermined direction, at least a portion of the through-hole (not illustrated) and at least a portion of the through-hole 16 are aligned.

4.1 Second Bearing 7

As illustrated in FIG. 8, the second bearing 7 is located at the second surface 2B. The second bearing 7 is attached to the second surface 2B. The second bearing 7 has a through-hole (not illustrated) into which the second protrusion 25 is inserted. Thereby, the second bearing 7 rotatably supports the supply roller shaft 4B. The second bearing 7 includes a coupling support section 42 and a developing bearing section 41 having a first hole 41A.

4.1.1 Coupling Support Section 42

As illustrated in FIG. 8, the coupling support section 42 is positioned between the developing roller shaft 3B and an idle gear 46 (to be described below). The coupling support section 42 is located at the second surface 2B. Specifically, the coupling support section 42 is located at an outer surface of the second bearing 7. The coupling support section 42 extends from the outer surface of the second bearing 7 in the predetermined direction. The coupling support section 42 has a cylindrical shape.

4.1.2 Developing Bearing Section 41

Figure 10:
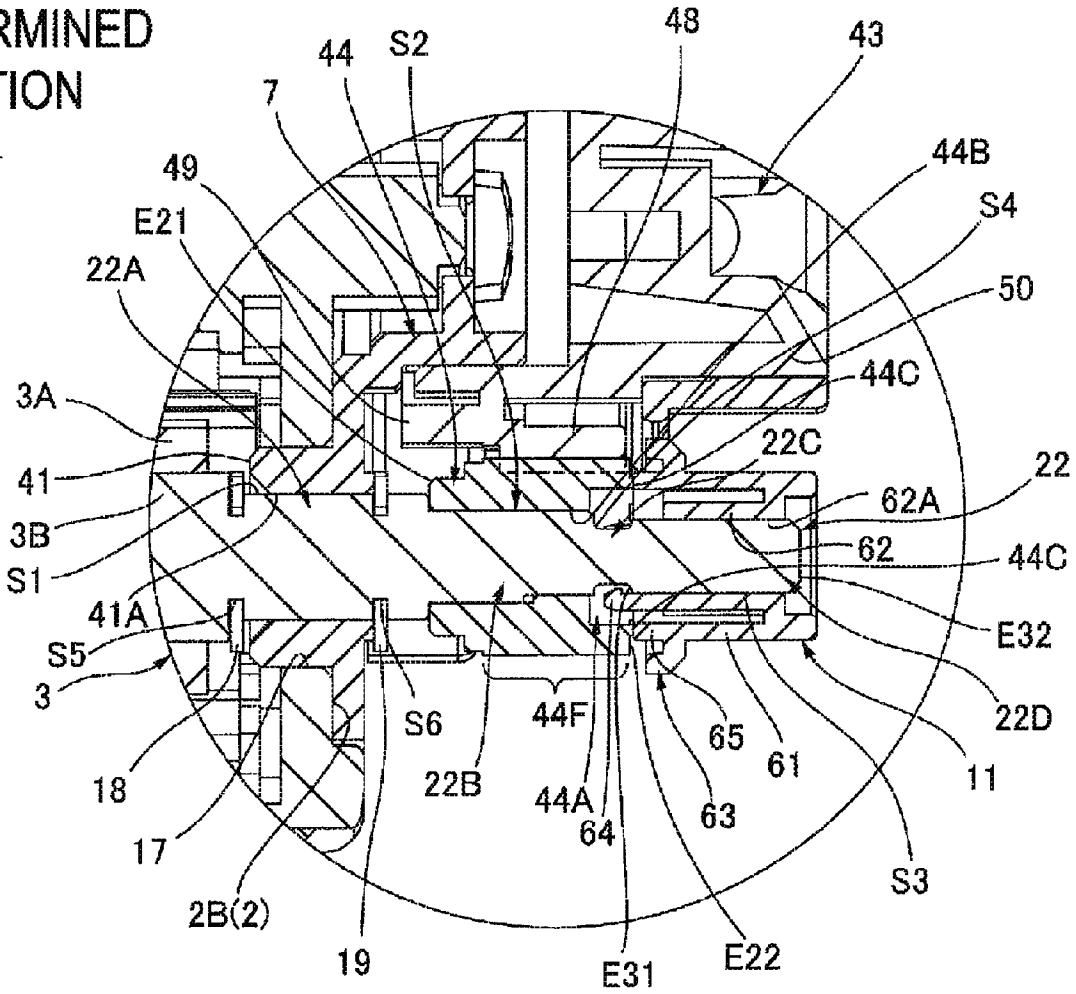
FIG. 10 is a cross-sectional view taken along line A-A of the developing cartridge illustrated in FIG. 6.

As illustrated in FIG. 10, the developing bearing section 41 extends in the predetermined direction. The developing bearing section 41 has a cylindrical shape. A size of an outer diameter of the developing bearing section 41 is the substantially same size of the inner diameter of the through-hole 17 of the second face 2B, and the developing bearing section 41 is fitted into the through-hole 17 of the second surface 2B.

The first hole 41A penetrates through the developing bearing section 41 in the predetermined direction. A size of an inner diameter of the first hole 41A is the substantially same size of the outer diameter of the first portion 22A of the developing roller shaft 3B. The first portion 22A is inserted into the first hole 41A. That is, the first circumferential surface S1 is inserted into the first hole 41A. The inner diameter of the first hole 41A has such a size that the outer diameter of the first circumferential surface S1 can be inserted. The inner diameter of the first hole 41A is greater than or equal to 6.02 mm and less than or equal to 6.07 mm. The inner diameter of the first hole 41A may be greater or equal to 5.00 mm and less than or equal to 7.00 mm. Thereby, the developing bearing section 41 of the second bearing 7 is attached to the first circumferential surface S1. The developing bearing section 41 of the second bearing 7 is positioned between the fifth circumferential surface S5 and the sixth circumferential surface S6. In this state, the fifth circumferential surface S5 is positioned between the developing bearing section 41 of the second bearing 7 and the developing roller section 3A.

4.2 First and Second Stoppers 18 and 19

As illustrated in FIG. 10, the first stopper 18 is positioned between the developing bearing section 41 of the second bearing 7 and the developing roller section 3A. As viewed in the predetermined direction, the first stopper 18 has a C shape. In other words, the first stopper 18 has a cylindrical shape in which a portion of the cylindrical shape in a circumferential direction of the first stopper 18 is cut off. The first stopper 18 is attached to the fifth circumferential surface S5.

The second stopper 19 is positioned between the developing bearing section 41 of the second bearing 7 and the developing roller gear. The second stopper 19 has the same shape as the first stopper 18. The second stopper 19 is attached to the sixth circumferential surface S6.

4.3 Gear Train 9

Figure 7:
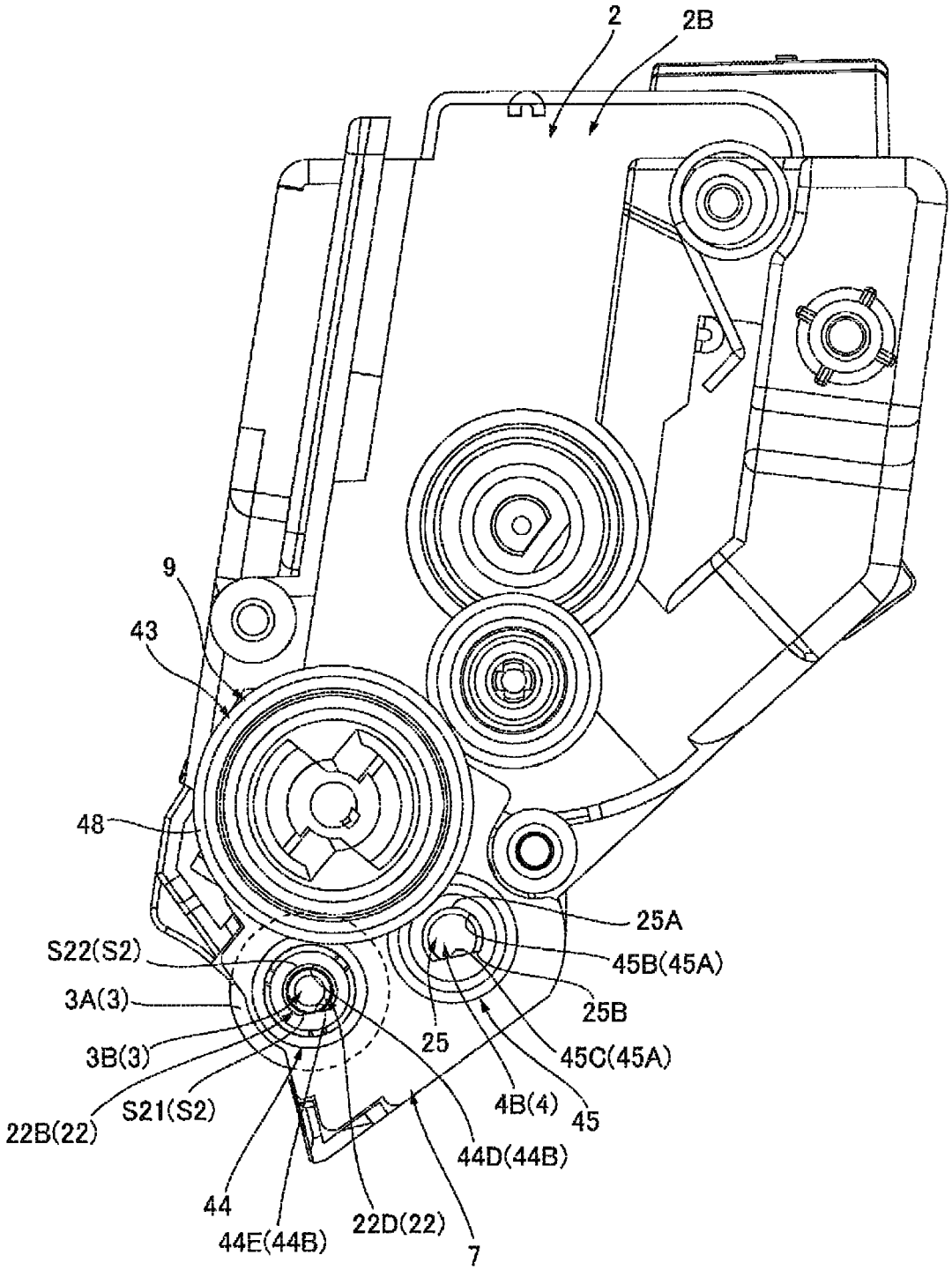
FIG. 7 is a side view in which a gear train is exposed with a gear cover removed in the developing cartridge illustrated in FIG. 6.

As illustrated in FIGS. 7 and 8, the gear train 9 is located at the second surface 2B. The gear train 9 includes a coupling 43, a developing roller gear 44, and a supply roller gear 45. The developing roller gear 44 has a second hole 44B.

4.3.1 Coupling 43

As illustrated in FIG. 8, the coupling 43 has a columnar shape. The coupling 43 extends in the predetermined direction. The coupling 43 is mounted to the coupling support section 42. The coupling 43 is rotatable about a central axis of the coupling support section 42 extending in the predetermined direction. The coupling 43 includes a joint 50, a first coupling gear section 48, and a second coupling gear section 49. The joint 50, the first coupling gear section 48, and the second coupling gear section 49 are integrally formed. Thereby, the first coupling gear section 48 and the second coupling gear section 49 are rotatable about the central axis of the coupling support section 42 along with rotation of the joint 50. The first coupling gear section 48 is located at a position farther from the second surface 2B than the second coupling gear section 49 in the predetermined direction. The joint 50 is located at a position farther from the second surface 2B than the first coupling gear section 48 in the predetermined direction.

The joint 50 is configured to receive a driving force from the outside of the developing cartridge 1. For example, when the image forming apparatus includes a driving input unit that configured input driving force to the joint 50, the driving input unit is engaged with the joint 50, and thereby the joint 50 can receive the driving force. Specifically, the joint 50 has a columnar shape extending in the predetermined direction. The joint 50 has a space 50A recessed inward from an outer surface of the joint 50 in the predetermined direction, and the joint 50 also includes an abutting section 50B and an abutting section 50C which are located in the space 50A. The abutting section 50B and abutting section 50C are spaced apart from each other in a radial direction of the joint 50. The abutting section 50B and abutting section 50C protrude toward the inside of the space 50A in the radial direction of the joint 50, respectively. The abutting section 50B and abutting section 50C are engaged with the driving input unit of the image forming apparatus, and receive the driving force, and thereby the joint 50 rotates relative to the coupling support section 42.

The first coupling gear section 48 is positioned between the joint 50 and the second coupling gear section 49 in the predetermined direction. The first coupling gear section 48 has a plurality of gear teeth 48A in a circumferential direction of the first coupling gear section 48. The plurality of gear teeth 48A are provided on an entire circumferential surface of the first coupling gear section 48. The plurality of gear teeth 48A are helical teeth meshed with gear teeth 44F of the developing roller gear 44. That is, the first coupling gear section 48 is a helical gear.

The second coupling gear section 49 is located at a position closer to the second bearing 7 than the first coupling gear section 48. An outer diameter of an addendum circle of the second coupling gear section 49 is smaller than an outer diameter of an addendum circle of the first coupling gear section 48. The second coupling gear section 49 has a plurality of gear teeth 49A in a circumferential direction of the second coupling gear section 49. The plurality of gear teeth 49A are provided on an entire circumferential surface of the second coupling gear section 49. The plurality of gear teeth 49A are helical teeth meshed with gear teeth 45D of the supply roller gear 45. That is, the second coupling gear section 49 is a helical gear.

4.3.2 Developing Roller Gear 44

Figure 9:
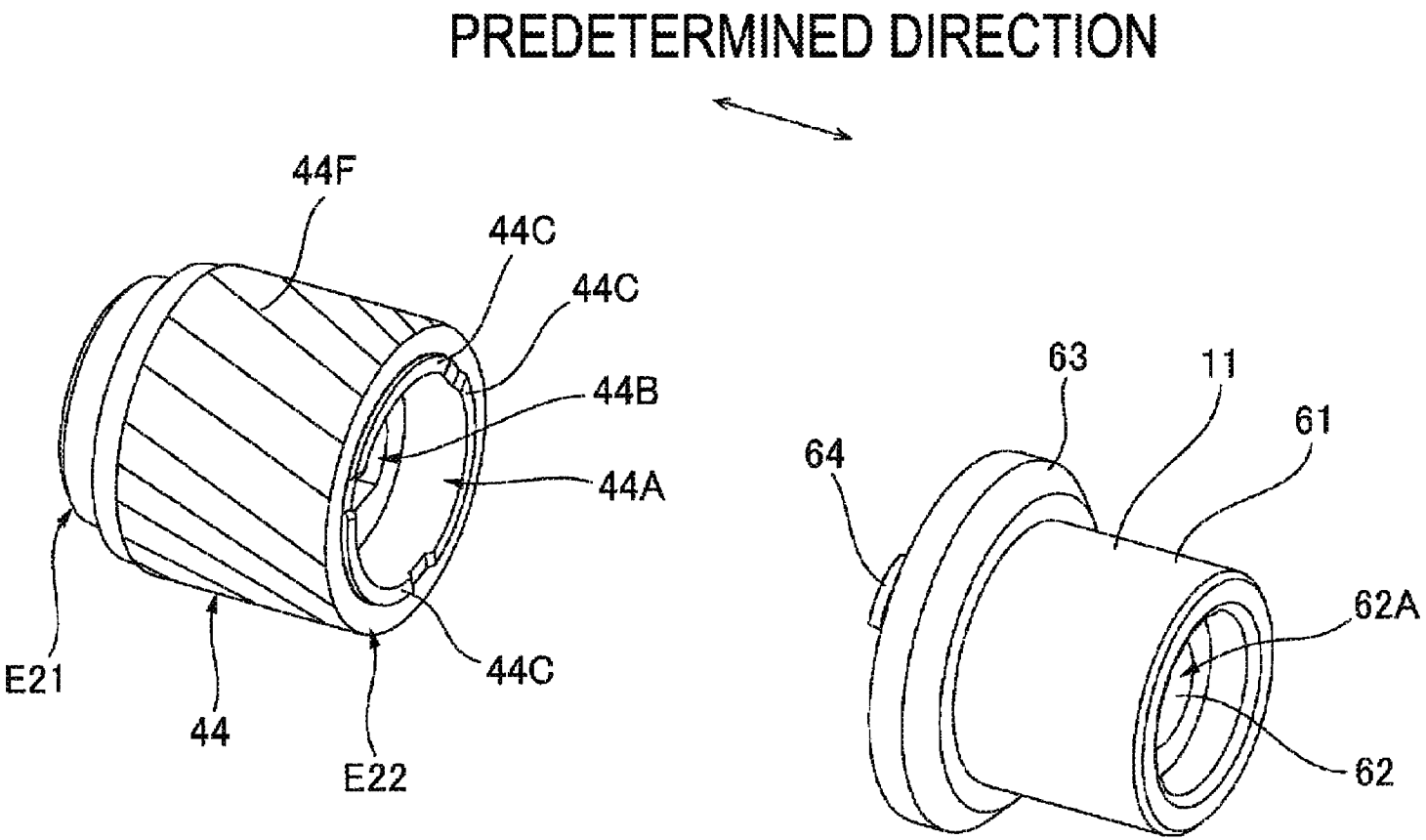
FIG. 9 is an enlarged view of a developing roller gear and a collar illustrated in FIG. 8.

As illustrated in FIGS. 8 to 10, the developing roller gear 44 is meshed with the first coupling gear section 48 of the coupling 43. The developing roller gear 44 has a columnar shape extending in the predetermined direction. The developing roller gear 44 has a first end E21 and a second end E22 in the predetermined direction. The second end E22 is located at a position farther from the second surface 2B than the first end E21 in the predetermined direction. The second end E22 has a recess 44A. The second end E22 is located at a position closer to the second collar 11 than the first end E21 in the predetermined direction. The developing roller gear 44 has a plurality of gear teeth 44F in a circumferential direction of the developing roller gear. The plurality of gear teeth 44F are provided on an entire circumferential surface of the developing roller gear 44. The gear teeth 44F are helical teeth meshed with the gear teeth 48A of the first coupling gear section 48 of the coupling 43. That is, the developing roller gear 44 is a helical gear. A helix direction of the gear teeth 44F of the developing roller gear 44 is different from a helix direction of the gear teeth 48A of the first coupling gear section 48. Helixes of the gear teeth 44F of the developing roller gear 44 can generate a thrust force that biases the developing roller gear 44 toward the second bearing 7. An outer diameter of an addendum circle of the developing roller gear 44 is smaller than an outer diameter of the developing roller section 3A. The outer diameter of the addendum circle of the developing roller gear 44 is greater than or equal to 9.269 mm and less than or equal to 9.369 mm. The outer diameter of the addendum circle of the developing roller gear 44 may be greater than or equal to 8.000 mm and less than or equal to 10.000 mm. The developing roller gear 44 includes a plurality of protrusions 44C.

The recess 44A is recessed from the second end E22 toward the first end E21 of the developing roller gear 44. The recess 44A has a circular shape as viewed in the predetermined direction. An inner diameter of the recess 44A is greater than an outer diameter of an inner tube section 62 of the second collar 11 (to be described below).

As illustrated in FIG. 7, the second hole 44B is located in the center of the developing roller gear 44. The second hole 44B has, for example, a D shape as viewed in the predetermined direction. In other words, an inner surface of the second hole 44B has an arc surface 44D and a flat surface 44E. The second hole 44B has such a size that the second hole 44B is fitted to the second circumferential surface S2. An inner diameter of the arc surface 44D is greater than or equal to 4.40 mm and less than or equal to 4.44 mm. The inner diameter of the arc surface 44D may be greater than or equal to 4.00 mm and less than or equal to 5.00 mm. The arc surface 44D and the flat surface 44E extend in the predetermined direction, respectively. The second circumferential surface S2 is inserted into the second hole 44B. The arc surface 44D faces the arc surface S21. The flat surface 44E faces the flat surface S22. Thereby, the developing roller gear 44 is mounted to the second circumferential surface S2, and is rotatable along with the second protrusion 22. In this state, the sixth circumferential surface S6 is positioned between the developing bearing section 41 of the second bearing 7 and the developing roller gear 44.

As illustrated in FIG. 10, the second end E22 faces the other end of the first portion 22A. Movement of the developing roller gear 44 in the predetermined direction is regulated by the first portion 22A. Thereby, the developing roller gear 44 is spaced apart from the second stopper 19 in the predetermined direction.

As illustrated in FIG. 9, the plurality of the protrusions 44C are located at the second end E22 in the predetermined direction. The plurality of the protrusions 44C are located outside the recess 44A in a radial direction of the developing roller gear 44. Each of the plurality of the protrusions 44C protrudes from the second end E22 of the developing roller gear 44 in the predetermined direction. Each of the plurality of the protrusions 44C extends in a circumferential direction of the developing roller gear 44. There are provided the plurality of the protrusions 44C, and the plurality of the protrusions 44C are provided apart from each other in the circumferential direction of the developing roller gear 44. Specifically, the three protrusions 44C are provided.

4.3.3 Supply Roller Gear 45

As illustrated in FIG. 8, the supply roller gear 45 is meshed with the first coupling gear section 48 of the coupling 43. The supply roller gear 45 has a disc shape having a thickness in the predetermined direction. The supply roller gear 45 has a plurality of gear teeth 45D in a circumferential direction of the supply roller gear 45. The gear teeth 45D are helical teeth meshed with the gear teeth 49A of the second coupling gear section 49 of the coupling 43. That is, the supply roller gear 45 is a helical gear. A helix direction of the gear teeth 45D of the supply roller gear 45 is identical to the helix direction of the gear teeth 44F of the developing roller gear 44, and is different from the helix direction of the gear teeth 49A of the second coupling gear section 49. Helixes of the gear teeth 45D of the supply roller gear 45 can generate a thrust force that biases the supply roller gear 45 toward the second bearing 7. The plurality of gear teeth 45D are provided on an entire circumferential surface of the supply roller gear 45. The supply roller gear 45 has a through-hole 45A.

As illustrated in FIG. 7, the through-hole 45A is located at the center of the supply roller gear 45. The through-hole 45A has, for example, a D shape as viewed in the predetermined direction. In other words, an inner surface of the through-hole 45A has an arc surface 45B and a flat surface 45C. The arc surface 45B and the flat surface 45C extend in the predetermined direction, respectively. The second protrusion 25 is inserted into the through-hole 45A. The arc surface 45B faces the arc surface 25A. The flat surface 45C faces the flat surface 25B. Thereby, the supply roller gear 45 is mounted to the second protrusion 25, and is rotatable along with the second protrusion 25.

4.4 Second Collar 11

As illustrated in FIGS. 9 and 10, the second collar 11 is located at a position farther from the second surface 2B than the developing roller gear 44 in the predetermined direction. That is, the second collar 11 is located on the opposite side of the second bearing 7 with respect to the developing roller gear 44 in the predetermined direction. The second collar 11 includes an outer tube section 61, and inner tube section 62, a base section 63, and a plurality of protrusions 65. The outer tube section 61, the inner tube section 62, the base section 63, and the protrusions 65 are integrally formed. The inner tube section 62 is provided inside the outer tube section 61. The inner tube section 62 has a through-hole 62A. The through-hole 62A is an example of a third hole.

The outer tube section 61 has a cylindrical shape. The outer tube section 61 has one end and the other end in the predetermined direction. The other end of the outer tube section 61 is located at a position farther from the second surface 2B than the one end of the outer tube section 61 in the predetermined direction.

The inner tube section 62 is located inside the outer tube section 61. That is, the outer tube section 61 surrounds a circumferential surface of the inner tube section 62. The inner tube section 62 has a cylindrical shape. The inner tube section 62 extends in the predetermined direction. The inner tube section 62 includes at least one claw 64. The inner tube section 62 has one end and the other end in the predetermined direction. The other end of the inner tube section 62 is located at a position farther from the second surface 2B than the one end of the inner tube section 62 in the predetermined direction.

The through-hole 62A penetrates through the inner tube section 62 in the predetermined direction. The through-hole 62A has such a size that the through-hole 62A is fitted to the third circumferential surface S3. A size of an inner diameter of the through-hole 62A is the substantially same size of the outer diameter of the third circumferential surface S3. The inner diameter of the through-hole 62A is, for example, greater than or equal to 3.52 mm and less than or equal to 3.57 mm. The inner diameter of the through-hole 62A may be greater than or equal to 3.00 mm and less than or equal to 4.00 mm. The third circumferential surface S3 is inserted into the through-hole 62A. Thereby, the inner tube section 62 is mounted to the third circumferential surface S3. The inner tube section 62 is slidable relative to the third circumferential surface S3. Thereby, the second collar 11 is rotatable relative to the developing roller shaft 3B.

The claw 64 is located at the one end of the inner tube section 62 in the predetermined direction. The claw 64 extends from the one end of the inner tube section 62 toward the developing roller gear 44 in the predetermined direction. An end of the claw 64 is bent to the inside of the inner tube section 62 in a radial direction of the inner tube section 62. The claw 64 is located in the recess 44A of the developing roller gear 44. In detail, the claw 64 is located in the space within the recess 44A. The claw 64 is attached to the fourth circumferential surface S4. The claw 64 can come into contact with the first end E31.

The base section 63 is located at the one end of the outer tube section 61 in the predetermined direction. The base section 63 extends in a radial direction of the outer tube section 61. The base section 63 extends in a circumferential direction of the outer tube section 61.

The plurality of the protrusions 65 are located on the opposite side of the outer tube section 61 with respect to the base section 63 in the predetermined direction. Each of the plurality of the protrusions 65 extend from the base section 63 toward the developing roller gear 44. Each of the protrusions 65 faces the associated protrusion 44C among the plurality of the protrusions 44C in the predetermined direction. Each of the protrusions 65 can come into contact with the associated protrusion 44C of the second end E22 of the developing roller gear 44 at an outer side of the inner tube section 62. Thereby, the each of the plurality of the protrusions 65 can restrict movement of the developing roller gear 44 in the predetermined direction. That is, the each of the plurality of the protrusions 65 can restrict a position of the developing roller gear 44 in the predetermined direction along with the first portion 22A.

5. Operation and Effects of Developing Cartridge 1

As illustrated in FIG. 10, the developing roller gear 44 is mounted to the second circumferential surface S2. An outer diameter of an addendum circle of the gear teeth 44F is smaller than the outer diameter of the developing roller section 3A.

For this reason, the second hole 44B of the developing roller gear 44 can be smaller by a difference between the outer diameter of the first circumferential surface S1 and the outer diameter of the second circumferential surface S2.

Thereby, a thickness of the developing roller gear 44 can be ensured by a difference between the outer diameter of the addendum circle of the gear teeth 44F and the inner diameter of the second hole 44B.

As a result, strength of the developing roller gear 44 can be ensured.

As the outer diameter of the addendum circle of the gear teeth 44F is smaller than the outer diameter of the developing roller section 3A, the circumferential surface of the developing roller section 3A can be reliably brought into contact with a circumferential surface of a photosensitive drum when the developing cartridge 1 is attached to the image forming apparatus.

As illustrated in FIG. 10, the developing cartridge 1 includes the second collar 11. The second collar 11 includes the claw 64 engaged with the third portion 22C. The claw 64 is engaged with the third portion 22C in the space within the recess 44A.

Thereby, the second collar 11 is mounted to the developing roller shaft 3B using the space within the recess 44A.

As illustrated in FIG. 10, the developing cartridge 1 includes the first stopper 18 and the second stopper 19. The developing roller gear 44 is located apart from the second stopper 19 in the predetermined direction.

Thereby, the developing roller gear 44 is mounted to the developing roller shaft 3B in the state where the developing roller gear 44 is spaced apart from the developing bearing section 41 of the second bearing 7.

As a result, the developing roller gear 44 can be smoothly rotated without coming into contact with the second bearing 7.

The developing bearing section 41 of the second bearing 7 is surely positioned relative to the developing roller shaft 3B in the predetermined direction by the first and second stoppers 18 and 19.

As illustrated in FIG. 8, the coupling 43 includes the first coupling gear section 48 and second coupling gear section 49. The developing roller gear 44 is the helical gear having the helixes capable of generating the thrust force that biases the developing roller gear 44 toward the second bearing 7. The supply roller gear 45 is the helical gear having the helixes capable of generating the thrust force that biases the supply roller gear 45 toward the second bearing 7.

Thus, when a driving force is input to the coupling 43 from the image forming apparatus, the driving force is transmitted to the developing roller gear 44 via the first coupling gear section 48 of the coupling 43, and further to the supply roller gear 45 via the second coupling gear section 49.

Then, the developing roller gear 44 and the supply roller gear 45 are rotated. Thereby, the developing roller 3 is rotated along with the developing roller gear 44. The supply roller 4 is rotated along with the supply roller gear 45. At this point, the developing roller gear 44 and the supply roller gear 45 are biased toward the second bearing 7 by the generated thrust force.

As a result, the developing roller gear 44 and the supply roller gear 45 can be surely positioned relative to the second bearing 7.

Figure 11A:
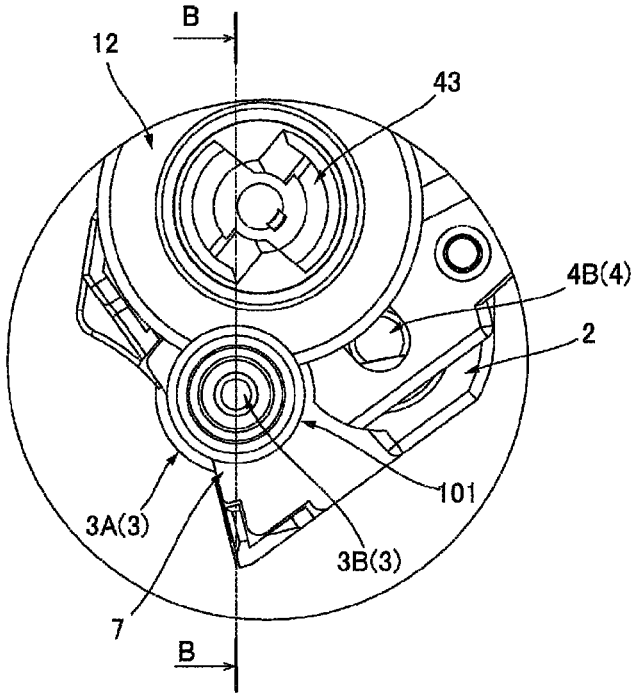
FIG. 11A is an illustrative view for illustrating a first modification of the developing cartridge and a side view of the first modification as viewed from the other side in the predetermined direction.
Figure 11B:
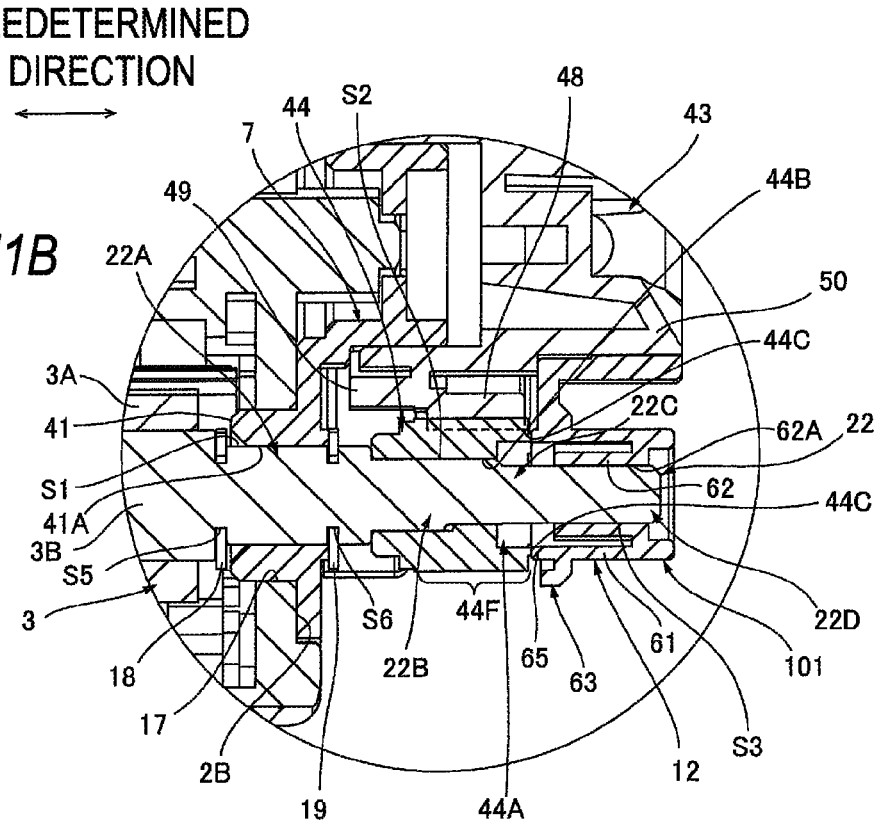
FIG. 11B is a cross-sectional view taken along line B-B of the developing cartridge illustrated in FIG. 11A.

6. Modification (1) In this embodiment, the second collar 11 is applied as an example of the regulating member. As illustrated in FIGS. 11A and 11B, the gear cover 12 may be applied as the regulating member. In this case, a collar section 101 having the same structure as the second collar 11 may be provided with the gear cover 12.

Figure 12A:
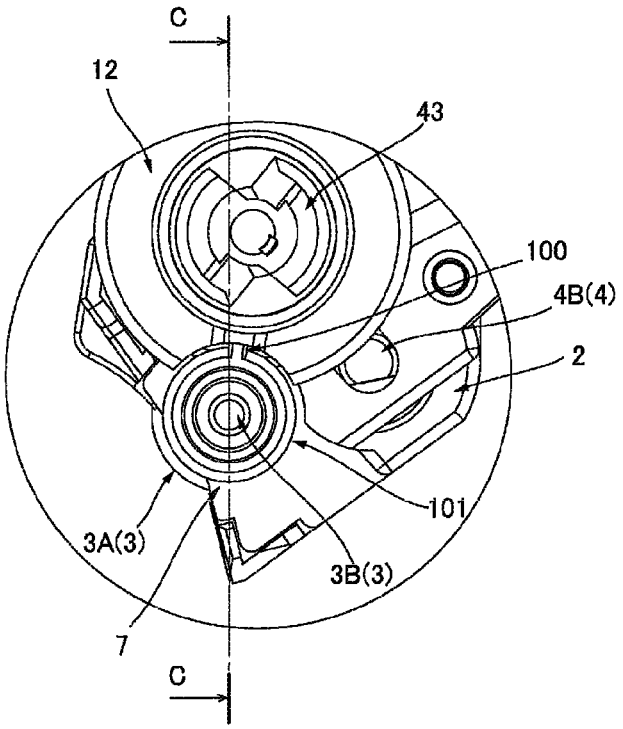
FIG. 12A is an illustrative view for illustrating a second modification of the developing cartridge and a side view of the second modification as viewed from the other side in the predetermined direction.
Figure 12B:
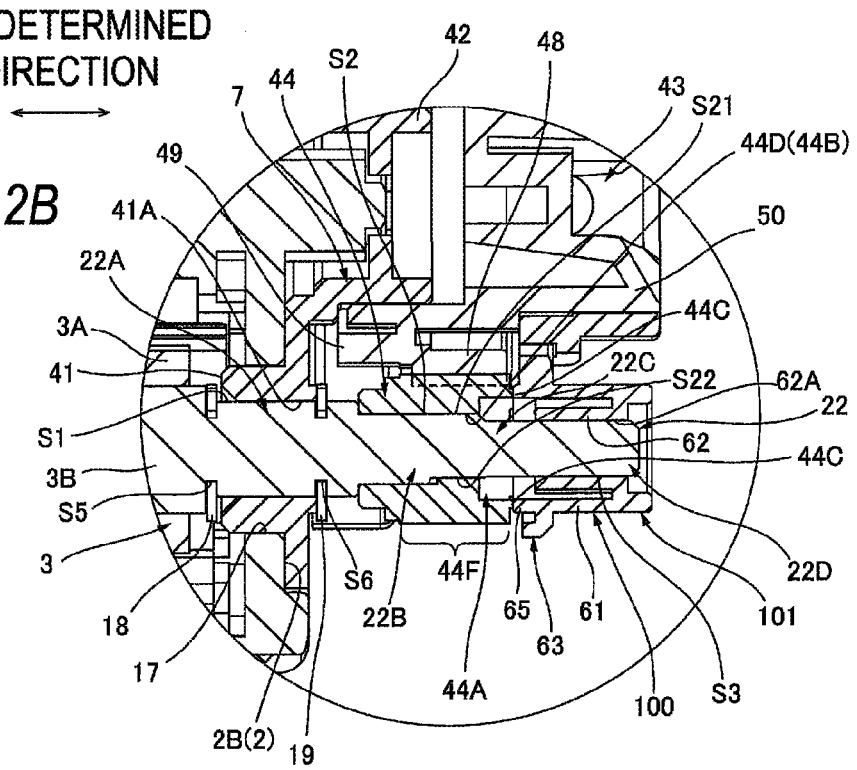
FIG. 12B is a cross-sectional view taken along line C-C of the developing cartridge illustrated in FIG. 12A.

As illustrated in FIGS. 12A and 12B, a member 100, which is different in shape from the second collar 11, may be applied as the regulating member.

(2) The developing roller shaft 3B may not penetrate through the developing roller section 3A in the predetermined direction. The developing roller shaft 3B may separately have a shaft (an example of the first shaft) extending the one end of the developing roller section 3A, and a shaft (an example of the second shaft) extending the other end of the developing roller section 3A in the predetermined direction.

(3) The supply roller shaft 4B may not penetrate through the supply roller section 4A in the predetermined direction. The supply roller shaft 4B may separately have a shaft (an example of the fourth shaft) extending the one end of the supply roller section 4A, and a shaft (an example of the third shaft) extending the other end of the supply roller section 4A in the predetermined direction.

What is claimed is:

1. A developing cartridge comprising:

a developing roller rotatable about a first axis extending in a predetermined direction, the developing roller including:

a developing roller section having a first end in the predetermined direction and a second end separated from the first end in the predetermined direction;

a first shaft extending from the first end of the developing roller section in the predetermined direction and being rotatable with the developing roller section; and a second shaft extending from the second end of the developing roller section in the predetermined direction and being rotatable with the developing roller section, the second shaft including:

a first circumferential surface having a first diameter;

a second circumferential surface having a second diameter which is smaller than the first diameter, the second circumferential surface being located at a position farther from the developing roller section than the first circumferential surface in the predetermined direction; and a third circumferential surface having a third diameter which is smaller than the second diameter and, the third circumferential surface being located at a position farther from the developing roller section than the second circumferential surface in the predetermined direction;

a bearing having a first hole into which the first circumferential surface is inserted, the bearing being mounted to the first circumferential surface;

a developing roller gear having a second hole into which the second circumferential surface is inserted, the developing roller gear being mounted to the second circumferential surface, the developing roller gear being rotatable with the second shaft, and the developing roller gear including a plurality of gear teeth provided on a circumferential surface of the developing roller gear, wherein a diameter of an addendum circle of the plurality of the gear teeth is smaller than a diameter of the developing roller section; and a regulating member having a third hole into which the third circumferential surface is inserted, the regulating member being located at an opposite side of the bearing with respect to the developing roller gear in the predetermined direction, and the regulating member configured to regulate a position of the developing roller gear in the predetermined direction.

2. The developing cartridge according to claim 1, wherein the second shaft includes a fourth circumferential surface having a fourth diameter which is smaller than the third diameter, the fourth circumferential surface being positioned between the second circumferential surface and the third circumferential surface in the predetermined direction, wherein the third circumferential surface has a first end in the predetermined direction and a second end separated from the first end of the third circumferential surface in the predetermined direction, wherein the first end of the third circumferential surface is located at a position closer to the fourth circumferential surface than the second end of the third circumferential surface in the predetermined direction, and wherein the regulating member is mounted to the fourth circumferential surface and the regulating member includes at least one claw being contactable with the first end of the third circumferential surface.

3. The developing cartridge according to claim 2, wherein the developing roller gear has a first end in the predetermined direction and a second end closer to the regulating member than the first end of the developing roller gear in the predetermined direction, wherein the second end of the developing roller gear has a recess which is recessed from the second end of the developing roller gear toward the first end of the developing roller gear, and wherein the claw is located in the recess.

4. The developing cartridge according to claim 3, wherein the regulating member includes an inner tube section which is mounted to the third circumferential surface, wherein the claw extends from the inner tube section toward the developing roller gear in the predetermined direction, and wherein the second end of the developing roller gear is contactable with a portion of the regulating member at an outer side of the inner tube section.

5. The developing cartridge according to claim 1, wherein the first circumferential surface includes a fourth circumferential surface having a fourth diameter which is smaller than the first diameter, the fourth circumferential surface being positioned between the bearing and the developing roller section in the predetermined direction, and wherein the developing cartridge further includes a first stopper being mounted to the fourth circumferential surface.

6. The developing cartridge according to any one of claim 1, wherein the first circumferential surface includes a fourth circumferential surface having a fourth diameter which is smaller than the first diameter, the fourth circumferential surface being positioned between the bearing and the developing roller gear in the predetermined direction, and wherein the developing cartridge further includes a second stopper being mounted to the fourth circumferential surface.

7. The developing cartridge according to claim 6, wherein the developing roller gear is located apart from the second stopper in the predetermined direction.

8. The developing cartridge according to claim 1, wherein the second circumferential surface has a D shape as viewed in the predetermined direction, and wherein the second hole is a D-shaped hole.

9. The developing cartridge according to claim 1, wherein the second circumferential surface includes a flat surface extending in the predetermined direction, and wherein the second hole extends in the predetermined direction, and the second hole includes an inner surface facing the flat surface.

10. The developing cartridge according to claim 1, wherein the regulating member is a collar being rotatable relative to the second shaft.

11. The developing cartridge according to claim 1, further comprising a coupling being rotatable about a coupling axis extending in the predetermined direction, the coupling including: a joint allowing a driving force to be received; and a first coupling gear section being rotatable about the coupling axis with the joint, the first coupling gear section being meshed with the developing roller gear.

12. The developing cartridge according to claim 11, wherein the developing roller gear is a helical gear, wherein the first coupling gear section is a helical gear, wherein a helix direction of the developing roller gear and a helix direction of the first coupling gear section are different from each other, and wherein helixes of the developing roller gear is capable of generating a thrust force that biases the developing roller gear toward the bearing.

13. The developing cartridge according to claim 11, further comprising:

a supply roller being rotatable about a second axis extending in the predetermined direction, the supply roller being configured to supply developer to the developing roller; the supply roller including:

a supply roller section having a first end in the predetermined direction and a second end separated from the first end of the supply roller section in the predetermined direction;

a third shaft extending from the first end of the supply roller section in the predetermined direction, the third shaft being rotatable with the supply roller section; and a fourth shaft extending from the second end of the supply roller section in the predetermined direction, the fourth shaft being rotatable with the supply roller section; and a supply roller gear being mounted to the third shaft, the supply roller gear being rotatable with the third shaft, wherein the coupling further includes:

a second coupling gear section being rotatable about the coupling axis with the joint, the second coupling gear section being meshed with the supply roller gear, and the second coupling gear section being located at a position closer to the bearing than the first coupling gear section in the predetermined direction.

14. The developing cartridge according to claim 13, wherein the developing roller gear is a helical gear, wherein the supply roller gear is a helical gear, wherein the first coupling gear section is a helical gear, wherein the second coupling gear section is a helical gear, wherein a helix direction of the developing roller gear and a helix direction of the supply roller gear are identical to each other, wherein the helix direction of the developing roller gear and a helix direction of the first coupling gear section are different from each other, wherein the helix direction of the supply roller gear and a helix direction of the second coupling gear section are different from each other, wherein helixes of the developing roller gear is capable of generating a thrust force that biases the developing roller gear toward the bearing, and wherein helixes of the supply roller gear is capable of generating a thrust force that biases the supply roller gear toward the bearing.

* * * * *